United States Patent [19]

Wu

[11] 3,930,514

[45] Jan. 6, 1976

[54] WIND RESISTANT UMBRELLA

[75] Inventor: Dean T. S. Wu, New York, N.Y.

[73] Assignee: Raymond Lee Organization Inc., New York, N.Y. ; a part interest

[22] Filed: Apr. 28, 1975

[21] Appl. No.: 572,161

[52] U.S. Cl. ..... 135/27; 135/15 CF

[51] Int. Cl.[2] ..... A45B 25/22

[58] Field of Search ..... 135/2, 15 CF, 27

[56] References Cited

UNITED STATES PATENTS

| | | | |
|---|---|---|---|
| 161,962 | 4/1875 | Horton | 135/27 |
| 559,577 | 5/1896 | Hadfield | 135/27 |
| 773,499 | 10/1904 | Hirsch et al. | 135/27 |
| 2,522,645 | 9/1950 | Senna | 135/27 |
| 3,042,055 | 7/1962 | Todorovic | 135/20 |

FOREIGN PATENTS OR APPLICATIONS

| | | | |
|---|---|---|---|
| 501,337 | 1/1920 | France | 135/27 |
| 390,555 | 12/1922 | Germany | 135/20 R |
| 121,459 | 8/1926 | Switzerland | 135/27 |

*Primary Examiner*—Werner H. Schroeder
*Assistant Examiner*—Conrad L. Berman

[57] ABSTRACT

A conventional umbrella has three hooks mounted upon each of its downwardly extending ribs. The first hook is located at the bottom of the rib. The second hook is located at the connection point of the rib and one of the elongated struts used to open and close the umbrella. The third hook is located on the same rib intermediate the first and second hooks. A flexible cable is attached to the first hook, passes or extends through the second and third hooks and is then attached to the center pole of the umbrella.

4 Claims, 2 Drawing Figures

WIND RESISTANT UMBRELLA

BACKGROUND OF THE INVENTION

Conventional umbrellas, when opened for use, can be turned inside out and broken by gusts of wind with relative ease whereby such umbrellas exhibit a relatively low resistance to attack by wind.

In contradistinction, in this invention a conventional umbrella is modified to exhibit a much higher resistance to attack by wind.

SUMMARY OF THE INVENTION

In accordance with the invention, flexible cables cooperate with the ribs and center pole of the umbrella. The umbrella has a collar slidable along the pole between a highest point (when the umbrella is open for use) and a lowest point (when the umbrella is closed or collapsed). The cables are strung along each rib and are secured to the pole above the highest point of the collar. Hooks are used to secure and guide the cables. The cables then act as two dimensional braces to sharply increase the resistance of the umbrella to attach by wind whereby the object of the invention is attained.

DETAILED DESCRIPTION OF PREFERRED EMBODIMENT

Figure 1:
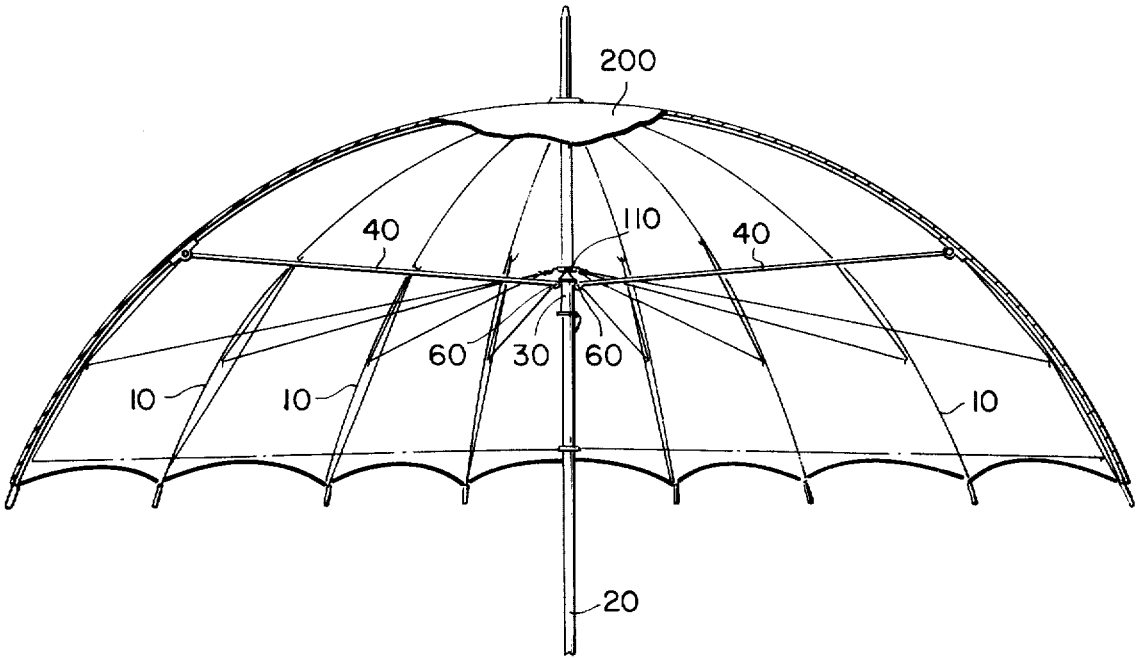
FIG. 1 is a side cross-sectional view of the invention.
Figure 2:
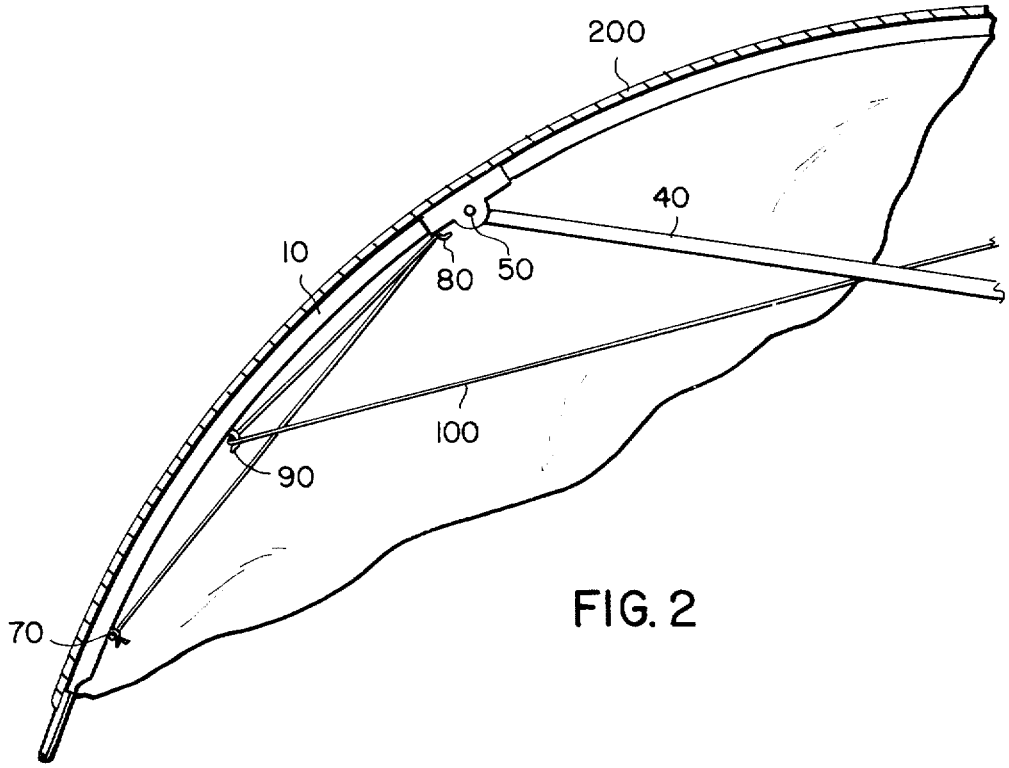
FIG. 2 is a detail view of a portion of the invention.

A conventional umbrella structure includes a plurality of downwardly extending ribs 10 located circumaxially around an elongated center pole 20. Slidibly attached to the pole, and shown in FIG. 1 in its highest position, is a collar 30. Between the collar and each rib is connected an elongated strut 40 that is pivotally secured to the rib at one point 50 and likewise pivotally secured to the collar at point 60.

On each rib is located a first hook 70, a second hook 80, and a third hook 90. The first hook is located near the bottom of the rib. The second hook is located at the pivotal connection point of one of the struts and the rib. The third hook is attached to the rib intermediate the first and second hooks. As can be seen, the first and third hooks face concave down, and the second hook faces concave upward.

A flexible cable 100 is strung between the center pole and each set of three hooks. Each cable is attached to the first hook, strung over the other two hooks in numerical sequence, and finally attached to a circular ring 110 surrounding the pole at a point above the highest position of the collar.

When the umbrella is opened as shown, each cable is stretched tight. When wind blows against the underside of the umbrella, the cables are pulled tighter, and force is exerted not only from hook 90 inwardly, but also from hook 70 towards hook 80 and from hook 80 to hook 90. Thus force is not only applied purely inwardly, but also along the direction of each rib, to keep the rib portions below point 50 from bending below hook 90.

The cables thus hold the umbrella in proper open position despite wind attack, each cable acting as a two dimensional brace.

Although the invention has been described with particular reference to the drawings, the protection sought is to be limited only by the terms of the claims which follow.

What is claimed is:

1. A wind resistant umbrella frame, comprising:

a frame having a plurality of like downwardly extending ribs located circumaxially around an elongated center pole and a collar slidably up and down on the pole, the collar being connected to each rib by an elongated strut that is pivotally connected at one end to the collar and pivotally connected at the other end to the rib, and flexible covering secured to the top of the pole and to the outside of the ribs;

a like plurality of first hooks, each first hook being secured to a corresponding rib adjacent the bottom thereof;

a like plurality of second hooks, each second hook being secured at the pivotal connection point of the corresponding rib and its associated strut;

a like plurality of third hooks, each third hook being secured to the corresponding rib between the corresponding first hook and the corresponding second hook; and a like plurality of flexible cables, each cable being secured at one end to one of said associated first hooks, and being looped over one of said corresponding second and third hooks, and being secured to the center pole at a point above the maximum position of upward travel of the collar.

2. The device of claim 1 wherein a circular ring is secured to the pole and the cables are secured to the ring.

3. The device of claim 2 wherein the first and third hooks face concave downward.

4. The device of claim 3 wherein the second hooks face concave upwards.

* * * * *